United States Patent [19]

Usui et al.

[11] Patent Number: 4,945,389

[45] Date of Patent: Jul. 31, 1990

[54] METHOD OF CLEANING A PHOTOCONDUCTIVE ELEMENT OF AN IMAGE RECORDER

[75] Inventors: Noriyuki Usui, Kawasaki; Tsumori Satoh, Yokosuka, both of Japan

[73] Assignee: Ricoh Company, Ltd., Tokyo, Japan

[21] Appl. No.: 356,058

[22] Filed: May 23, 1989

[30] Foreign Application Priority Data

May 23, 1988 [JP] Japan ..... 63-125197

[51] Int. Cl.[5] ..... G03G 21/00

[52] U.S. Cl. ..... 355/296; 355/208; 355/278; 355/301; 430/125

[58] Field of Search ..... 355/296–298, 355/301, 303, 305, 316, 219, 203, 208; 430/125

[56] References Cited

U.S. PATENT DOCUMENTS

| | | | |
|---|---|---|---|
| 3,788,739 | 1/1974 | Coriale | 355/219 X |
| 4,278,342 | 7/1981 | Andrew et al. | 355/296 X |
| 4,326,796 | 4/1982 | Champion et al. | 355/219 X |
| 4,378,421 | 3/1983 | Larson | 430/125 X |
| 4,417,804 | 11/1983 | Werner, Jr. | 355/208 X |
| 4,511,240 | 4/1985 | Suzuki et al. | 355/219 X |
| 4,533,236 | 8/1985 | Garsin | 355/303 X |
| 4,752,810 | 6/1988 | Schmidlin et al. | 355/303 |
| 4,819,026 | 4/1989 | Lange et al. | 355/303 X |
| 4,837,600 | 6/1989 | Kasai et al. | 355/219 X |

FOREIGN PATENT DOCUMENTS

| | | | |
|---|---|---|---|
| 0006251 | 1/1981 | Japan | 355/219 |

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

A cleaning method applicable to a photoconductive element installed in an electrophotographic copier or similar image recorder of the type performing repetitive steps of charging, exposing, developing, transferring, discharging, cleaning and so forth. The method includes the steps of measuring the surface potential of the photoconductive element remaining after discharging which occurs prior to cleaning, comparing the measured potential with a reference potential, and controlling the output voltage of a discharging device to maintain the surface potential constant.

6 Claims, 5 Drawing Sheets

METHOD OF CLEANING A PHOTOCONDUCTIVE ELEMENT OF AN IMAGE RECORDER

FIELD OF THE INVENTION

The present invention relates to a method of cleaning a photoconductive element installed in an electrophotographic copier, facsimile machine or similar image recorder which is implemented by an electrophotographic procedure.

BACKGROUND OF THE INVENTION

With an electrophotographic image recorder, it has been customary to improve and stabilize the quality of image recording by measuring the surface potential of a photoconductive element, or image carrier, immediately after the surface of the photoconductive element has been charged by a charger, comparing the measured potential with a predetermined reference value, and so controlling the output of the charger, the amount of imagewise exposure and so forth so as to maintain the surface potential constant.

After a toner image has been transferred from the surface of the photoconductive element to a paper sheet or similar material, toner particles remains on the photoconductive element. It is a common practice to remove the remaining toner particles by discharging the surface of the photoconductive element after the image transfer and then sweeping away the particles by use of a magnet brush to which a bias voltage is applied.

In general, the cleaning ability available with a system of the kind using a bias voltage as stated above is greatly effected by an electric field acting during the course of cleaning, (i.e., an electric field developed by the surface potential of the photoconductive element after the discharging which precedes cleaning and the bias voltage applied to the magnet brush). Specifically, effective cleaning is achievable only when the cleaning electric field lies in a certain range. Otherwise, the cleaning ability is lowered to invite an occurrence that toner particles adhere to the photoconductive element after the cleaning. The cleaning electric field, or surface potential of the photoconductive element after discharging, often varies over a wide range with the degree of contamination and deterioration of a wire of a discharger, the aging of the photoconductive element, etc. It is therefore necessary to adequately control the surface potential of the photoconductive element after the discharging so that the cleaning ability may be improved. A cleaning system which implements such a manner of control has not been proposed yet.

OBJECTS OF THE INVENTION

It is therefore an object of the present invention to provide a cleaning method for an image recorder capable of cleaning a photoconductive element with improved cleaning ability and stability.

It is another object of the present invention to provide a cleaning method for an image recorder which controls the surface potential of a photoconductive element to a predetermined value before cleaning the photoconductive element.

It is yet another object of the present invention to provide a generally improved cleaning method for an image recorder.

SUMMARY OF THE INVENTION

A cleaning method for removing toner particles remaining on a photoconductive element which is installed in an image recorder of the present invention comprises the steps of measuring a potential being deposited on a surface of the photoconductive element after the surface has been discharged prior to a cleaning step, comparing the measured potential with a predetermined reference potential, and adjusting an output voltage for discharging on the basis of a result of the comparison, whereby the surface potential of the photoconductive element is constantly controlled to a predetermined value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
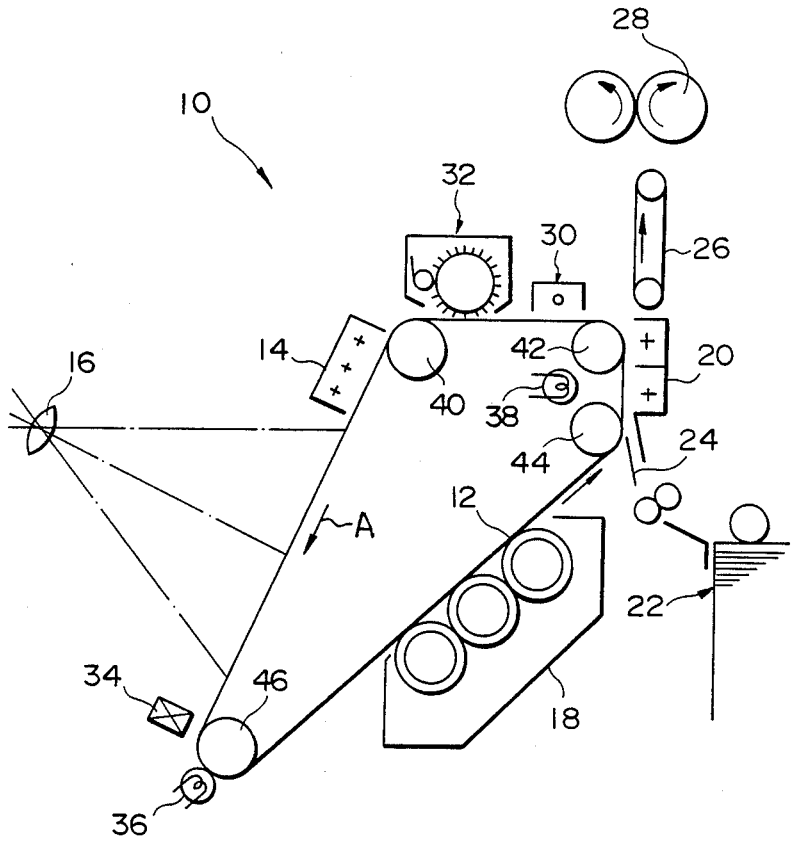
FIG. 1 is a schematic view showing an electrophotographic copier to which a cleaning method in accordance with the present invention is applied.

Referring to FIG. 1 of the drawings, an electrophotographic copier to which a cleaning method of the present invention is applied is shown and generally designated by the reference numeral 10. As shown, the copier 10 has a photoconductive element in the form of a belt 12 which is rotatable in a direction indicated by an arrow A. While the belt 12 is so rotated, a latent image is electrostatically formed on the belt 12 by a main charger 14 and optics 16 adapted for imagewise exposure and then developed by a developing device 18 to become a toner image. A paper sheet 24 fed from a paper feed section 22 is charged from the back by a transfer charger 20 to the polarity opposite to the polarity of the toner, whereby the toner image is transferred from the belt 12 to the paper sheet 24. A transport belt 26 is driven to transport the paper sheet 24 carrying the toner image thereon to a fixing roller pair 28, so that the toner image is fixed on the paper sheet 24. A discharging device 30 is located upstream of a cleaning device 32 with respect to the direction of rotation of the belt 12. The discharging device 30 deposits a charge of the same polarity as the toner on the belt 12 to thereby regulate the charge of the toner and charge the belt 12 to the same polarity as the toner. By such a function of the discharging device 30, the electrostatic adhesion acting between the belt 12 and the toner is reduced and, therefore, the cleaning ability of the cleaning device 32 is enhanced. In the figure, the copier 10 is shown as further having a potential sensor 34, discharge lamps 36 and 38, and rollers 40, 42, 44 and 46.

Figure 2:
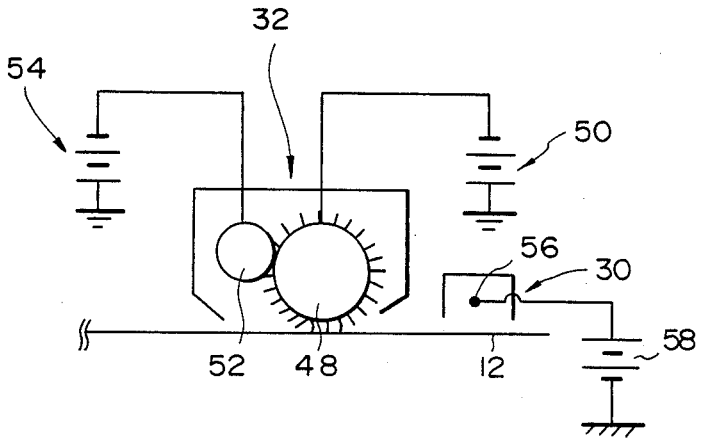
FIG. 2 is a schematic diagram showing specific constructions of a cleaning device and a discharging device which are installed in the copier of FIG. 1.

FIG. 2 shows specific constructions of the cleaning device 32 and discharging device 30. The cleaning device 32 has a cleaning brush roller 48 to which a cleaning bias voltage is applied from a cleaning bias source 50, and a scavenging roller 52 to which a scavenging bias voltage is applied from a scavenging bias source 54. The discharging device 30 is implemented by a charge wire 56 to which a discharging voltage is applied from a high-tension power supply 58. Toner particles remaining on the belt 12 after image transfer are charged by the discharging device 30 to the positive polarity, for example. At this instant, a bias voltage of the opposite polarity to the toner (i.e., a negative bias voltage in this example) is applied to the cleaning brush roller 48. Hence, the remaining toner on the belt 12 is electrostatically attracted by the cleaning brush roller 48 and thereby removed from the belt 12.

Figure 3:
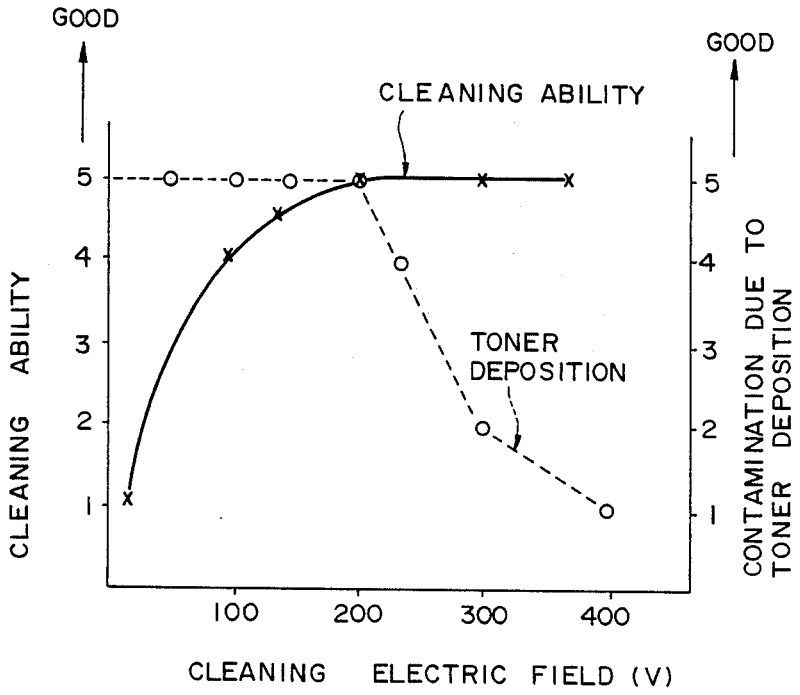
FIG. 3 is a plot representative of a relationship between the cleaning electric field and the cleaning ability.

The cleaning ability is mainly effected by the cleaning electric field acting during the cleaning operation, (i.e., the surface potential of the belt 12 developed by the discharging which is effected by the discharging device 30 prior to cleaning and the cleaning bias voltage which is fed from the bias source 50). As FIG. 3 indicates, the cleaning ability is sequentially improved as the cleaning electric field becomes more intense. However, when the electric field exceeds a certain value, toner particles begin to adhere to the surface of the belt 12 resulting in the background of a reproduction being contaminated. Presumably, such deposition of toner particles is ascribable to an occurrence that an excessively high bias voltage for cleaning causes the opposite charge to be injected into the toner via a magnet brush which is formed on the cleaning brush roller 48. Further, the potential on the belt 21 after the discharging performed by the discharging device 30 varies over a wide range depending on the contamination and deterioration of the charge wire 56 of the discharging device 30 and the charging characteristics and aging of the belt 12. The cleaning electric field, therefore, varies with the potential on the belt 12 to bring about the contamination of the background of a reproduction.

For the reasons discussed above, it is necessary that the cleaning electric field be constantly controlled to a certain range. The method of the present invention controls the cleaning electric field adequately, especially the surface potential of the belt 12 after the discharging performed by the discharging device 30 and the bias voltage applied to the cleaning brush roller 48.

Figure 4:
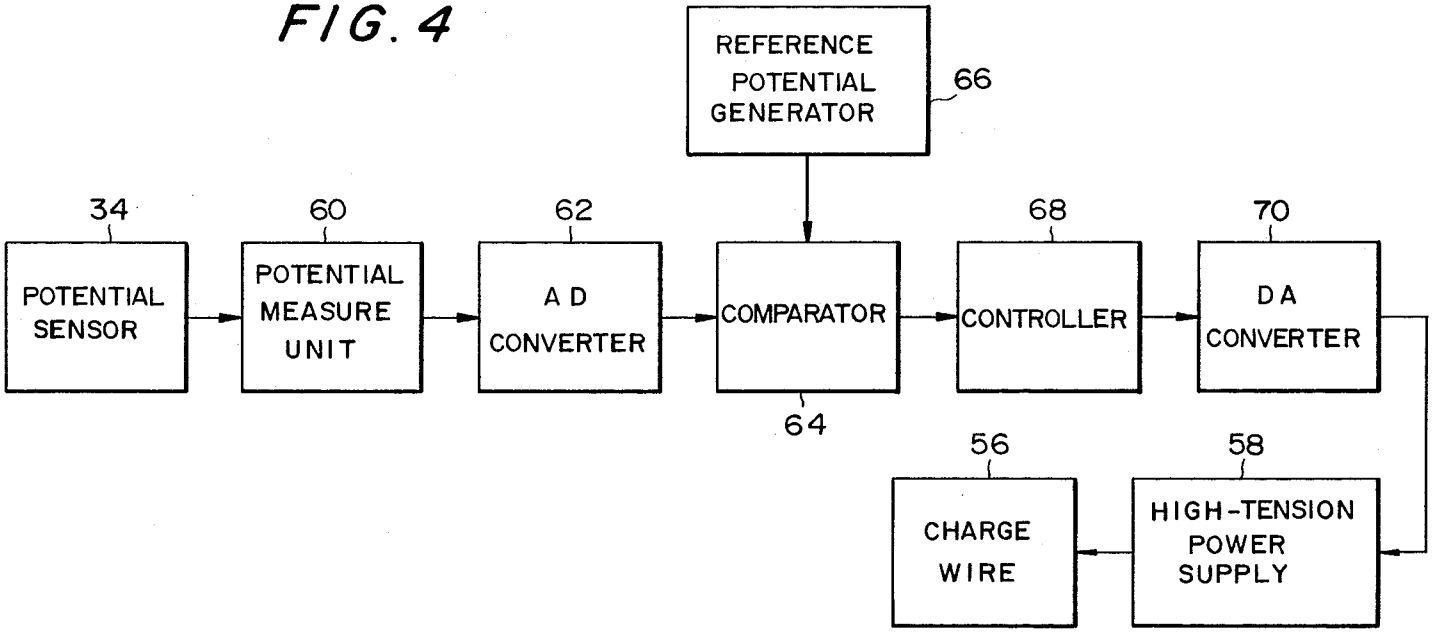
FIG. 4 is a schematic block diagram showing a system for practicing the cleaning method of the present invention.

Referring to FIG. 4, a system for practicing the cleaning method of the present invention is shown in a block diagram. In the figure, the potential sensor 34 senses a surface potential of the belt 12 which has been discharged prior to cleaning. The output of the potential sensor 34 is routed through a surface potential measuring unit 60 and an analog-to-digital (AD) converter 62 to a comparator 64. The comparator 64 compares the sensed surface potential of the belt 12 with a predetermined reference potential which is fed thereto from a reference potential generator 66. The result of comparison is delivered from the comparator 64 to a controlling 68. The output of the controller 68 in turn is fed to a high-tension power supply 58 via a digital-to-analog (DA) converter 70, so that the controlled output of the high tension power supply 58 is applied to the charge wire 56 of the discharging device 30. Consequently, the surface potential of the belt 12 deposited by the discharging which precedes cleaning is controlled to a desired value so as to stabilize the cleaning electric field.

Figure 5:
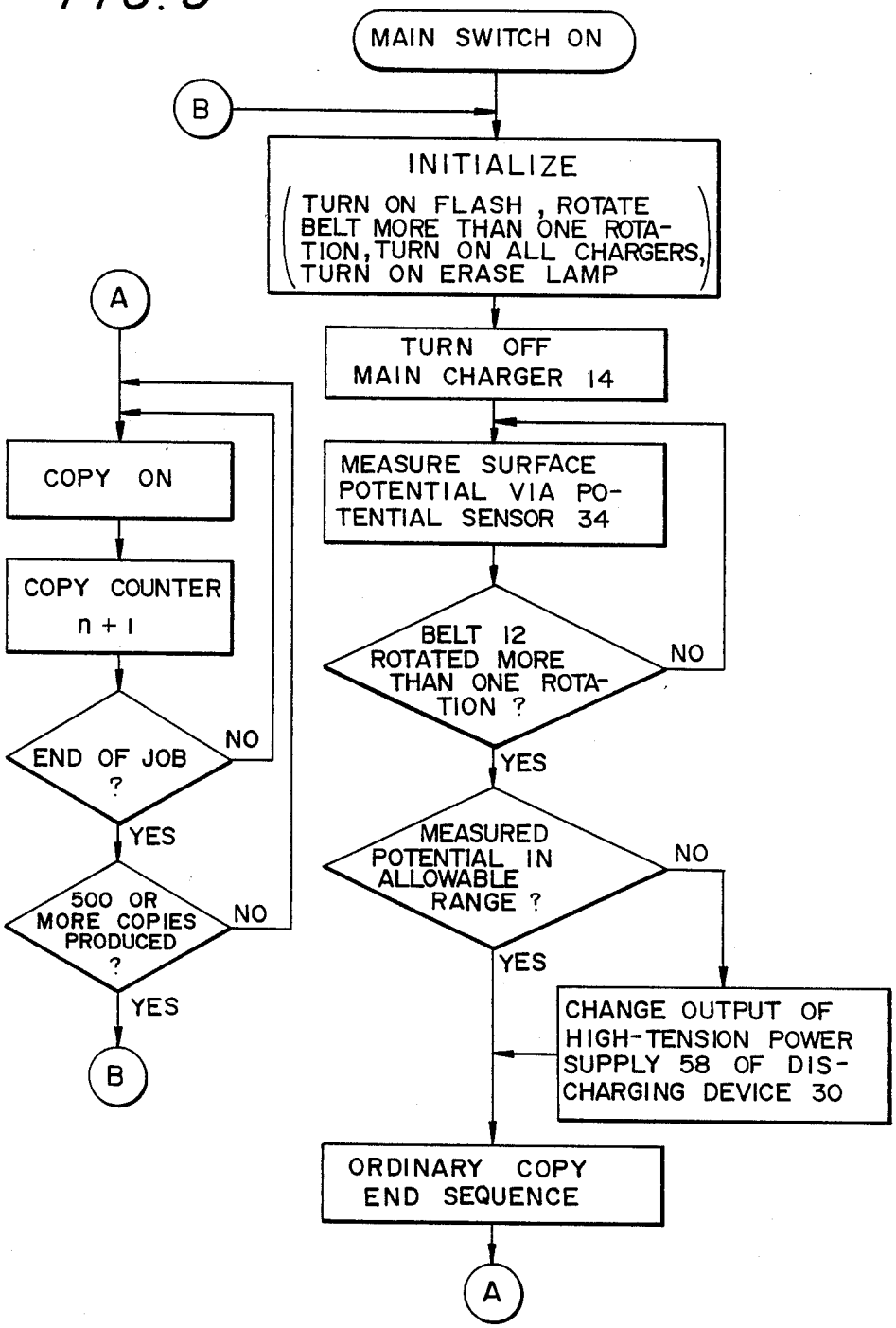
FIG. 5 is a flowchart useful for understanding the cleaning method of the present invention.

FIG. 5 shows a specific procedure for measuring the surface potential of the belt 12 which remains after the discharging. As shown, when a main switch provided on the copier 10 is turned on, the surface of the belt 12 is initialized to predetermined conditions. Then, only the main charger 14 is turned off. (Otherwise the surface potential after the discharging would be cancelled.) In this condition, the measured potential and the reference potential are compared as described with reference to FIG. 4. If the measured potential does not lie in the allowable range, the controller 68 changes the output voltage of the high-tension power supply 58 of the discharging device 30. This is followed by an ordinary copy mode. The measurement may be effected, not only when the main switch is turned on, but also when a predetermined number of copies are produced, so as to cope with the aging of the belt 12 as well.

In summary, it will be seen that the present invention provides a cleaning method capable of cleaning stably with improved ability a photoconductive element installed in an electrophotographic copier or similar image recorder of the type performing repetitive steps of charging, exposing, developing, transferring, discharging, cleaning and so forth. This advantage of the present invention is derived from the unique sequence of steps of measuring the surface potential of a photoconductive element remaining after discharging which occurs prior to cleaning, comparing the measured potential with a reference potential, and controlling the output voltage of a discharging device to maintain the surface potential constant.

Various modifications will become possible for those skilled in the art after receiving the teachings of the present disclosure without departing from the scope thereof.

What is claimed is:

1. A cleaning method for removing toner particles remaining on a photoconductive element which is installed in an image recorder, said method comprising the steps of:

(a) producing a predetermined number of copies; then (b) measuring a potential being deposited on a surface of the photoconductive element after said surface has been discharged and prior to a cleaning step; then (c) comparing the measured potential of the surface of the photoconductive element with a predetermined reference potential; and then, still prior to the cleaning step, (d) adjusting an output voltage for discharging the surface of the photoconductive element on the basis of a result of the comparison such that the surface potential of the photoconductive element is controlled to a predetermined value.

2. A cleaning method as claimed in claim 1, and further comprising the step of controlling a bias voltage applied to a magnetic brush for cleaning.

3. A cleaning method as claimed in claim 2, wherein the output voltage for discharging the surface of the photoconductive element and the bias voltage applied to the magnetic brush are opposite in polarity to each other.

4. A cleaning method for removing toner particles remaining on a photoconductive element which is installed in an image recorder, said method comprising the steps of:

(a) turning the main switch of the image recorder on; then, prior to producing copies, (b) discharging the surface of the photoconductive element; then (c) measuring a potential being deposited on the surface of the photoconductive element; then (d) comparing the measured potential of the surface of the photoconductive element with a predetermined reference potential; then (e) adjusting an output voltage for discharging the surface of the photoconductive element on the basis of a result of the comparison such that the surface potential of the photoconductive element is controlled to a predetermined value; and then (f) performing a cleaning step.

5. A cleaning method as claimed in claim 4, and further comprising the step of controlling a bias voltage applied to a magnetic brush for cleaning.

6. A cleaning method as claimed in claim 5, wherein the output voltage for discharging the surface of the photoconductive element and the bias voltage applied to the magnetic brush are opposite in polarity to each other.

* * * * *